US006978837B2

(12) United States Patent
Yemington

(10) Patent No.: US 6,978,837 B2
(45) Date of Patent: Dec. 27, 2005

(54) PRODUCTION OF NATURAL GAS FROM HYDRATES

(76) Inventor: Charles R. Yemington, 2700 Revere St., Suite 149, Houston, TX (US) 77098

( * ) Notice: Subject to any disclaimer, the term of this patent is extended or adjusted under 35 U.S.C. 154(b) by 0 days.

(21) Appl. No.: 10/890,040

(22) Filed: Jul. 13, 2004

(65) Prior Publication Data

US 2005/0103498 A1 May 19, 2005

Related U.S. Application Data

(60) Provisional application No. 60/519,497, filed on Nov. 13, 2003.

(51) Int. Cl.[7] ..... E21B 36/00; E21B 43/24; E21B 43/04

(52) U.S. Cl. ..... 166/303; 166/302; 166/278; 166/57; 166/58; 166/59; 166/267; 299/14

(58) Field of Search ..... 166/300, 302, 166/303, 262, 265, 267, 278, 272.1, 57–60, 166/63; 175/11, 16; 299/8, 9, 14; 585/15

(56) References Cited

U.S. PATENT DOCUMENTS 2,985,238 A * 5/1961 Dixon ..... 166/262
3,916,993 A 11/1975 Katz
3,920,072 A 11/1975 Kern
3,952,802 A * 4/1976 Terry ..... 166/262
4,007,787 A 2/1977 Cottle
4,147,456 A 4/1979 Klass
4,371,045 A 2/1983 McGuire et al.
4,376,462 A 3/1983 Elliott et al.
4,424,858 A 1/1984 Elliott et al.
4,424,866 A 1/1984 McGuire
4,750,983 A 6/1988 Foster et al.
4,886,119 A * 12/1989 Bernhardt et al. ..... 166/267
4,920,752 A 5/1990 Ehrsam
5,261,490 A 11/1993 Ebinuma
5,268,477 A 12/1993 McCall et al.
5,322,943 A 6/1994 McCall et al.
5,324,436 A 6/1994 John et al.
5,434,330 A 7/1995 Hnatow et al.
5,473,904 A 12/1995 Guo et al.
5,540,190 A 7/1996 Rogers et al.
5,613,362 A 3/1997 Dixon
5,660,603 A 8/1997 Elliot et al.
RE35,696 E * 12/1997 Mikus ..... 166/303
5,713,416 A 2/1998 Chatterji et al.
5,723,702 A 3/1998 Kwon et al.
5,789,635 A 8/1998 Durand et al.
5,873,262 A 2/1999 Max et al.
5,900,516 A 5/1999 Talley et al.
5,950,732 A 9/1999 Agee et al.
5,964,093 A 10/1999 Heinemann et al.
5,981,816 A 11/1999 Sinquin et al.

(Continued)

*Primary Examiner*—David Bagnell
*Assistant Examiner*—Shane Bomar
(74) *Attorney, Agent, or Firm*—Derek V. Forinash; David A. Rose; Kurt S. Myers

(57) ABSTRACT

Methods and apparatus for producing methane gas from a hydrate formation. A column of modified material substantially filling a wellbore extending into the hydrate formation. The column of modified material is permeable to gases. A heat source extends into the column of modified material and is operable to provide heat to the hydrate formation so as to release methane gas from the hydrate formation. Methane gas flow through the column of modified material to a gas collector, which regulates the flow of gas to a production system.

39 Claims, 12 Drawing Sheets

U.S. PATENT DOCUMENTS 6,028,234 A 2/2000 Heinemann et al.
6,028,235 A 2/2000 Heinemann et al.
6,035,933 A 3/2000 Kahalil et al.
6,082,118 A 7/2000 Endrizzi et al.
6,148,911 A 11/2000 Gipson et al.
6,158,239 A 12/2000 Max et al.
6,178,670 B1 1/2001 Susman et al.
6,180,843 B1 1/2001 Heinamann et al.
6,192,691 B1 2/2001 Nohmura
6,209,965 B1 4/2001 Borns et al.
6,214,175 B1 4/2001 Heinemann et al.
6,216,804 B1 4/2001 Aumann et al.
6,228,146 B1 * 5/2001 Kuespert ..... 95/46
6,230,825 B1 5/2001 Aumann et al.
6,267,849 B1 7/2001 Taylor et al.
6,299,256 B1 10/2001 Wyatt
6,305,482 B1 10/2001 Aumann et al.
6,306,917 B1 10/2001 Bohn et al.
6,307,191 B1 10/2001 Waycuilis
6,347,531 B1 2/2002 Roberts et al.
6,378,631 B1 4/2002 Aumann et al.
6,389,820 B1 5/2002 Rogers et al.
6,417,415 B1 7/2002 Sakaguchi et al.
6,475,460 B1 11/2002 Max
6,497,794 B1 12/2002 Max
6,499,536 B1 12/2002 Ellingsen
6,531,034 B1 3/2003 Max
6,562,234 B2 5/2003 Max
6,565,626 B1 5/2003 Baker et al.
6,565,715 B1 5/2003 Max
6,570,045 B2 5/2003 Sakaguchi et al.
6,572,678 B1 6/2003 Wijmans et al.
6,620,091 B1 9/2003 Zavell et al.
6,653,516 B1 11/2003 Yoshikawa et al.
6,659,204 B2 12/2003 Aumann et al.
6,673,249 B2 1/2004 Max
6,673,479 B2 1/2004 McArthur et al.
6,733,573 B2 5/2004 Lyon
6,733,667 B2 5/2004 Max
6,735,960 B2 5/2004 Mao et al.
6,759,564 B2 7/2004 Max et al.
6,767,471 B2 7/2004 Max
6,817,427 B2 11/2004 Matsuo et al.
6,824,171 B2 11/2004 Milberger et al.
6,830,682 B2 12/2004 Max
6,855,852 B1 2/2005 Jackson
6,890,444 B1 5/2005 Max
2002/0169345 A1 11/2002 Johnson
2003/0136585 A1 7/2003 Matsuo et al.
2005/0092482 A1 * 5/2005 Wendland ..... 166/57
2005/0161217 A1 * 7/2005 Wittle et al. ..... 166/248

* cited by examiner

PRODUCTION OF NATURAL GAS FROM HYDRATES

CROSS-REFERENCE TO RELATED APPLICATIONS

The present application claims priority to U.S. Provisional Application No. 60/519,497, filed Nov. 13, 2003, titled "Production of Natural Gas from Hydrates," and hereby incorporated herein by reference for all purposes.

STATEMENT REGARDING FEDERALLY SPONSORED RESEARCH OR DEVELOPMENT

Not Applicable.

FIELD OF THE INVENTION

The present invention relates generally to methods and apparatus for extracting gaseous hydrocarbons from subterranean formations. More particularly, the present invention relates to extracting gaseous hydrocarbons from gas hydrate formations.

BACKGROUND

Production of gas from subterranean oil and gas reservoirs by drilling and installation of grouted casings is a well-established practice. Natural gas (methane) production has primarily been achieved through drilling wells into deep reservoirs where natural gas, frequently in association with crude oil and water, may be trapped under a layer of cap rock. The well is lined with a casing that is cemented to the surrounding formation to provide a stable wellbore. The casing is then perforated at the reservoir level to allow gas and reservoir fluids to flow into the casing and then to the surface through tubing inside the casing.

In these cased well applications, one or more concentric casings are installed to progressively greater depths, down to a pressurized reservoir. Cementing, or grouting, the casing (s) to the formation material, and to adjacent casings, prevents hydrocarbons from escaping from the pressurized reservoir along the exterior of the casing. Gas enters the lower part of the casing via perforations in the casing or, in highly consolidated (rock) reservoir formation material, via an un-cased extension of the drilled hole.

In most applications, a "packer" is used to isolate the lower part of the casing from the upper part and one or more strings of production tubing hang from the wellhead down to the zone below the packer or between adjacent packers. After entering the casing via the perforations, the gas enters the tubing string(s) where it flows to the surface, through valves, and to a pipeline. The cased well method facilitates control of the flow of gas from a high-pressure reservoir and is well suited for production from porous rock or sand formation material.

Methane hydrates, or hydrates, are one type of formation material found close to the surface, especially in cold environments. Methane hydrates are similar to water ice and are composed primarily of water, methane, and, to a lesser extent, other volatile hydrocarbons. The frozen water particles form an expanded lattice structure that traps the methane, or other hydrocarbon particles, to form a primarily solid material.

Methane hydrates have been found to be stable over a range of high pressure and low temperature. Methane hydrates are stable at combinations of temperature and pressure found in onshore arctic regions and beneath the sea floor in water depths greater than approximately 1,500 feet (500 meters). Changes in either the temperature or the pressure can cause methane hydrates to melt and release natural gas. Methane gas may also be trapped below the hydrate layer, much as it is trapped below cap rock layers in deep underground reservoirs.

The development of viable methods for the commercial production of natural gas from naturally occurring deposits of methane hydrates has been the subject of extensive research. The construction of standard cased wells has been used to reduce the pressure on the underside of the hydrate-bearing zone. This approach collects gas that is trapped below the hydrates and, by reducing the pressure, may cause hydrates in the surrounding formation to release additional natural gas. This release will cease when the formation materials isolate the remaining hydrates from the zone of reduced pressure or when the latent heat of thawing causes the temperature to drop sufficiently to stabilize the remaining hydrates at the reduced pressure. Thawing absorbs heat equal to the latent heat of the hydrates and, if this heat is not replaced, the temperature will drop and conditions will eventually shift into the stability region for hydrates, whereupon release of methane from the hydrates will stop.

Notwithstanding the above teachings, there remains a need to develop new and improved methods and apparatus, for producing hydrocarbon gases from subterranean hydrates, which overcome some of the foregoing difficulties while providing more advantageous overall results.

SUMMARY OF THE PREFERRED EMBODIMENTS

The embodiments of the present invention are directed toward methods and apparatus for recovering hydrocarbons from subterranean hydrates. A column of modified material substantially filling a wellbore extends into the hydrate formation. A heat source extends into the column of modified material and is operable to provide heat to the hydrate formation so as to release methane gas from the hydrate formation. Methane gas flows through the column of modified material to a gas collector, which regulates the flow of gas to a production system.

In one embodiment, a well for producing hydrocarbons from hydrate deposits includes a wellbore containing a column of material modified for permeability and/or heat conductivity. The well also comprises a heat source for heating the hydrate formation to release hydrocarbon gases. The hydrocarbon gases pass through the permeable material up through the wellbore and is captured. Gas captured can be collected and/or processed to provide useful hydrocarbon gas products.

The embodiments of the present invention include provisions for forcing the release of natural gas from the hydrates and provisions for producing the released gas. These embodiments may also include provisions for delivering produced gas to a chamber suitable for separating gas from water, storing gas, drying gas, and regulating flow. Embodiments may also include commingling gas from multiple wells in a controlled manner and delivering the gas to a pipe or pipeline. These embodiments can be used to produce gas from hydrate formations that are not suitable for production by conventional wells. Certain embodiments can also be used to extend the life of wells used to produce hydrates.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
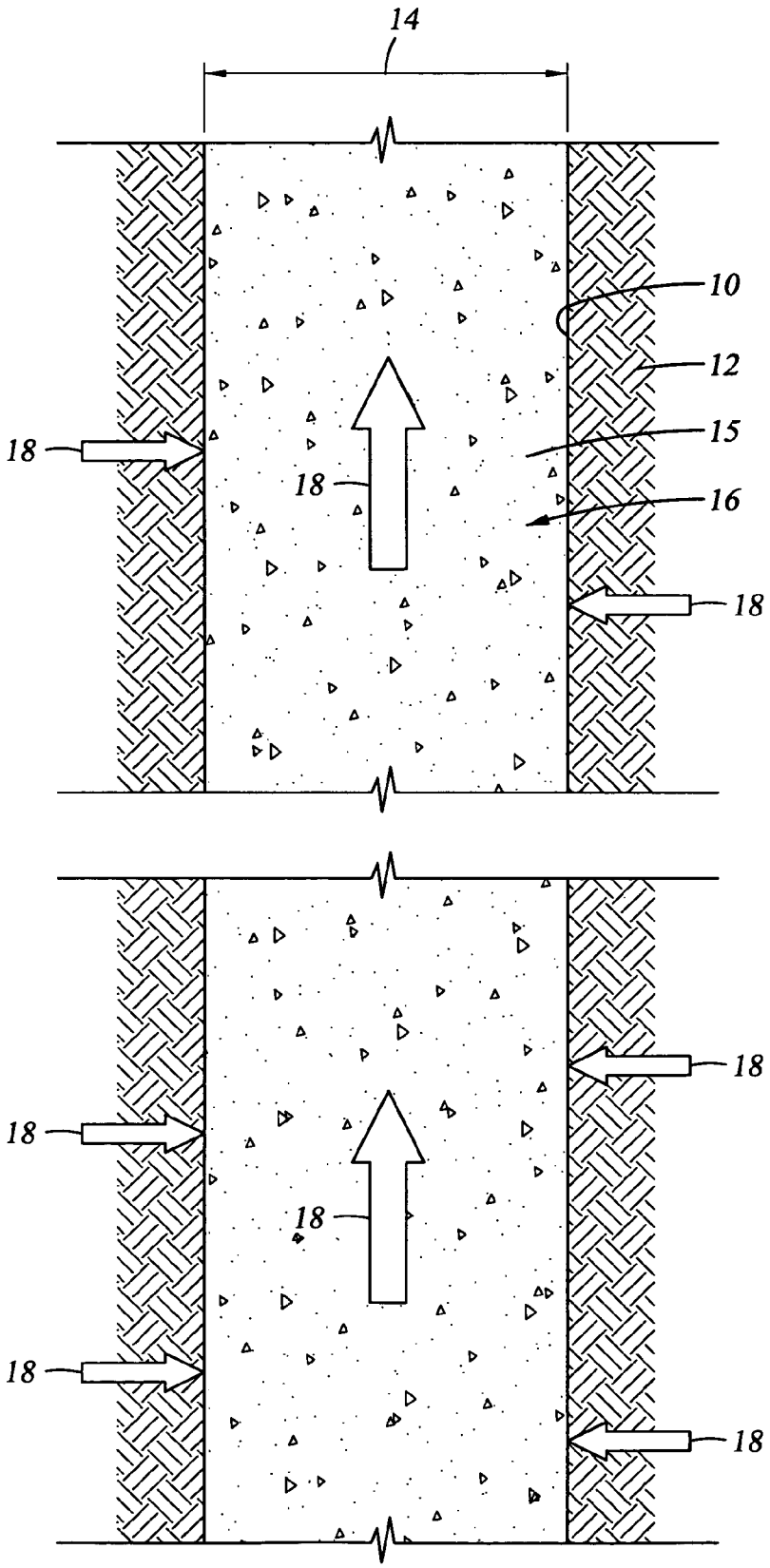
FIG. 1 is a schematic illustration of a hydrate production apparatus constructed in accordance with embodiments of the present invention and illustrating the flow of gas from the formation into the wellbore.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. For example, the concepts of the present invention can be used in deviated, horizontal, and directional wells, as well as the vertical wells used in the following description.

In particular, various embodiments described herein thus comprise a combination of features and advantages that overcome some of the deficiencies or shortcomings of prior art hydrate production systems. The various characteristics mentioned above, as well as other features and characteristics described in more detail below, will be readily apparent to those skilled in the art upon reading the following detailed description of preferred embodiments, and by referring to the accompanying drawings.

The embodiments of the present invention are described in the context of the production of natural gas from hydrates that occur naturally in arctic permafrost or within sediments that comprise the deep ocean seabed, typically at water depths of 1,500 feet and deeper. Except where otherwise indicated, it is assumed that the pressure within these hydrate formations is at or near the corresponding ambient pressure for the depth at which the formation is found. Hydrate formations will release hydrocarbon gases as either the temperature of the formation is increased or the pressure on the formation is decreased. The embodiments of the present invention seek to produce hydrocarbon gases from these hydrate formations using novel production apparatus designs and methods.

Referring now to FIG. 1, a section of a wellbore 10 is shown disposed in a hydrate formation 12. As wellbore 10 is drilled to a diameter 14, at least a portion of the formation material is removed from the wellbore and replaced or combined with a selected material 15 to create a column 16 of modified material that fills the wellbore. The selected material 15 may be chosen to adjust the permeability and/or thermal conductivity of the column 16. For example, materials of particular granular size can be used to make wellbore 10 permeable to liquids and gases while being relatively impermeable to particulate matter, thus allowing flow of gas while filtering unconsolidated formation materials that might otherwise interfere with gas production.

Thus, in the following discussion, modified material 15 should be taken to define a material having a different permeability and/or thermal conductivity than the surrounding formation. The modified material 15 may be a slurry or a granular solid material that substantially fills a wellbore. In this context, substantially fills is defined as where the material 15 is in direct contact with the hydrate formation 12 and fills wellbore 10 irrespective of other wellbore-installed members, such as tubing and casing, or interstitial areas formed between adjacent particles of the modified material.

The selection of the materials forming the column of modified material may also be made with some consideration to regulating the heat flow from the wellbore into the formation. Thermal conductivity can be regulated by changing the liquid content or by injecting materials having the desired thermal conductivity into modified column 16. Examples of materials with high thermal conductivity that may be suitable for use include, naturally occurring minerals or ores, refined or processed minerals, metals, or ceramics, and industrial byproducts. Exemplary materials include metal ores and coke breeze. Fabricated devices such as metal fibers, metal particles, metallic oxides, or liquid filled volumes may also be placed in column 16 to enhance thermal conductivity. The modified material may preferably be a slurry, for which conventional pumping methods can be used to inject the slurry into wellbore 10.

For the purposes of the following description, the modified column 16 is considered to be permeable to gases and/or have a high thermal conductivity. Thus, as hydrate formation 12 releases hydrocarbon gases 18, the gases flow into wellbore 10 and up through modified column 16 toward the top of the well.

Figure 2:
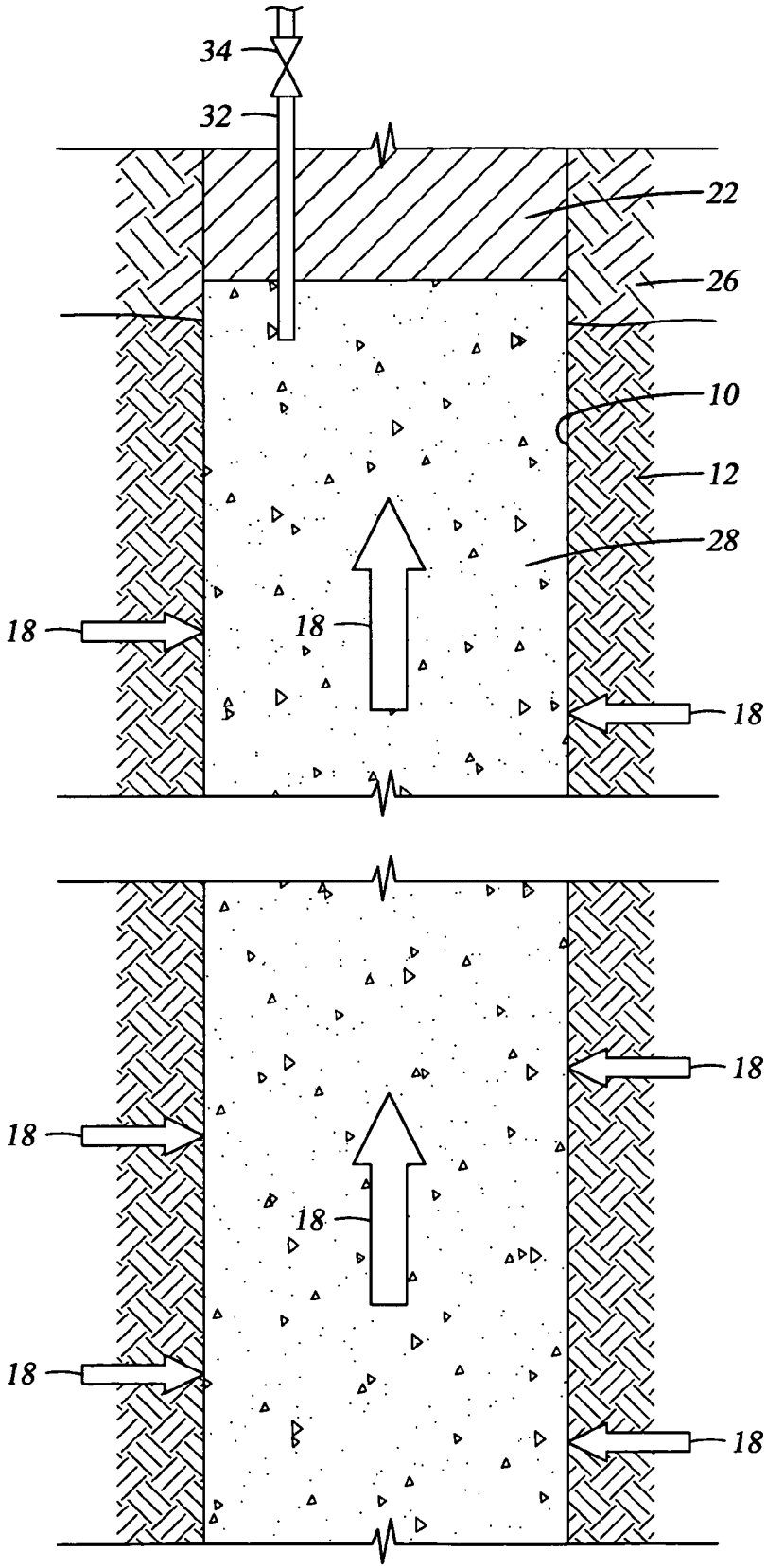
FIG. 2 is a schematic illustration of a hydrate production apparatus including an impermeable cap constructed in accordance with embodiments of the present invention.

FIG. 2 shows wellbore 10 having a cap 22 at the top of the well. Wellbore 10 is disposed in a hydrate formation 12 having an upper layer 26 that is impermeable. As in FIG. 1, wellbore 10 contains a column of modified material 28. Cap 22 is installed at the top of wellbore 10 to act as a gas collector and stop the flow of gas 18 up through the wellbore. Cap 22 may be formed from cement, grout, or some other substantially impermeable material. Cap 22 may extend through upper layer 26 to whatever depth is desired to minimized the escape of gases through the surrounding formation. Tubing 32 is installed through cap 22 to provide an outlet for removing gas 18 from wellbore 10. Valve 34 may be installed on tubing 32 to allow the tubing to be closed and the well shut-in.

Figure 3:
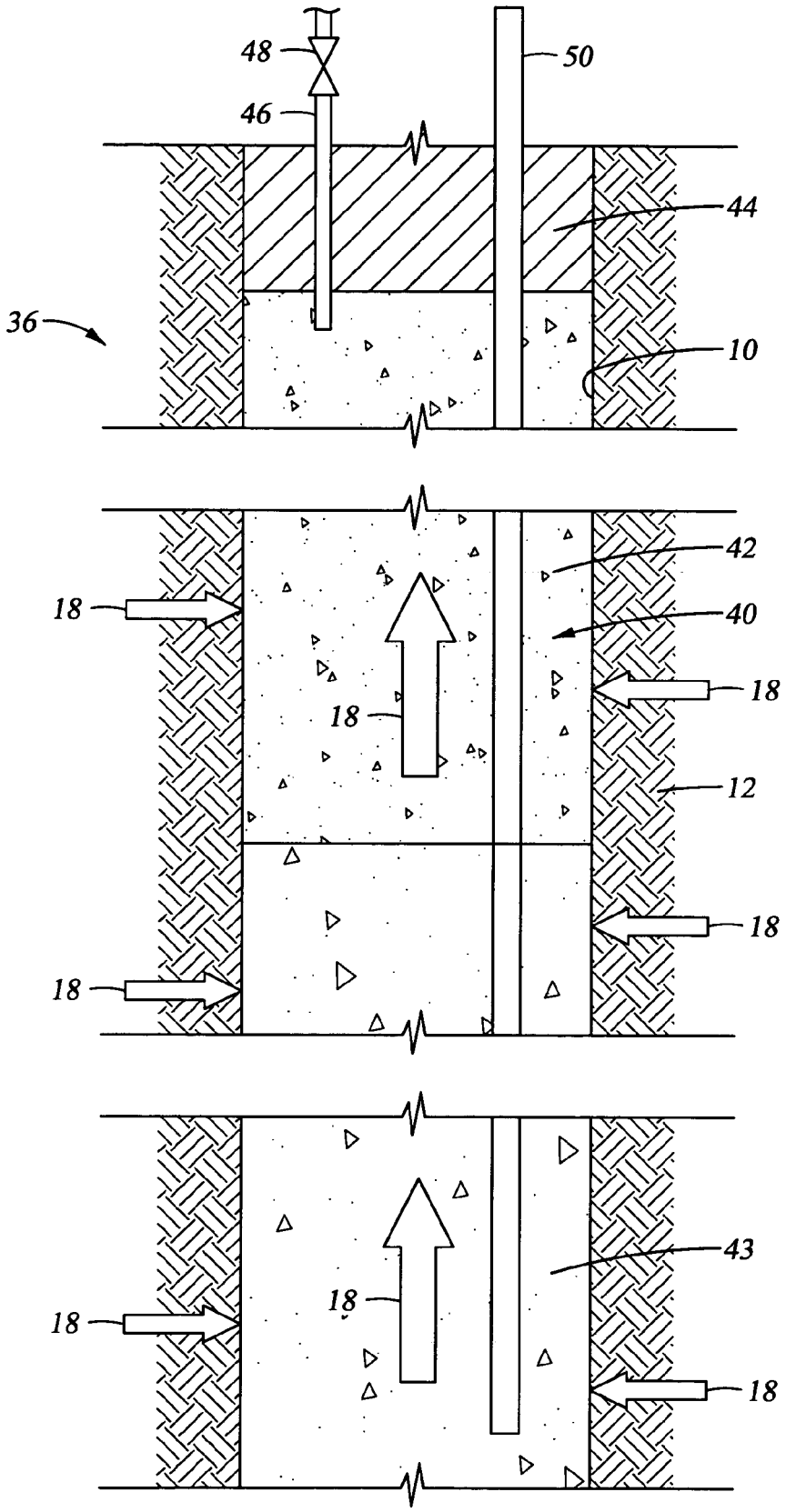
FIG. 3 is a schematic illustration of a hydrate production apparatus including an impermeable cap and a heat source constructed in accordance with embodiments of the present invention.

A heat-injecting well 36 is shown in FIG. 3. Well 36 includes wellbore 10 drilled into hydrate formation 12 and containing a column 40 with a first zone 42 and a second zone 43 having different compositions of modified material. Well 36 also includes cap 44, tubing 46, valve 48, and heat source 50. Heat source 50 provides heat to wellbore 10, which is transferred through modified material 42 into hydrate formation 12. In the preferred embodiments, modified material 42 has thermal conductivity properties that enable a high efficiency in transferring heat from heat source 50 into formation 12. The multiple zones 42, 43 may allow selected properties of column 40 to vary between the zones. For example, the thermal conductivity of column 40 may be lower in first zone 42 so as to limit the heat transfer into the upper regions of formation 12. In some embodiments, the permeability of column 40 may also be varied so as to control the flow of gas through the column.

When heat is transferred to formation 12 by heat-injecting well 36, hydrates in close proximity to the well thaw first, with thawing extending farther out as time progresses. Thawing of the hydrates releases hydrocarbon gases, such as methane. Methane released in close proximity to well 36 flows toward the inlet of tubing 46, on the outside of heat source 50, and through modified material 42, which has been disturbed during drilling of wellbore 10 and/or modified to change its permeability or thermal conductivity. Methane liberated at a greater distance from well 36 is effectively blocked from vertical upward migration by naturally occurring layers of consolidated materials, and by hydrate ice in the pores and fissures of the undisturbed formation 12. Increased pressure resulting from thermal liberation of gaseous methane from solid ice, causes the released methane to flow primarily horizontally or diagonally upward through the thawed zone until it can move vertically through well 36. Proximity to a heat source helps prevent hydrates from reforming in wellbore 10 and accelerates the methane migration through the wellbore to the inlet of tubing 46.

A heat-injecting well causes gas to be released by thawing the hydrates. The thawing generates sufficient pressure to cause the gas to migrate into and through a permeable wellbore from where it can be produced. The heat for the heat-injecting well may be from any available source, including hot fluids, combustion of fuel and oxidizer, hot combustion gases, or electrical resistance heating. Combustion may be at any location remote from the heat-injecting well, or may occur inside the heat-injecting well. An ambient or cooled liquid or gas can also be injected into the well in order to decrease the temperature of the surrounding formation. This decrease in temperature will reduce and eventually stop the hydrates from thawing, thus limiting the release of gas into the wellbore.

Cap 44 not only controls the flow of gas, but also allows further control of thermal effects on the formation in the region around the cap. Reducing the thermal conductivity around the upper part of the well allows the upper levels of sediment to remain cold. Isolation of the upper layers of sediment from heating can help maintain the structural stability of the formation, and help maintain a relatively impermeable cap over the hydrate area to help reduce the escape of methane.

Figure 4:
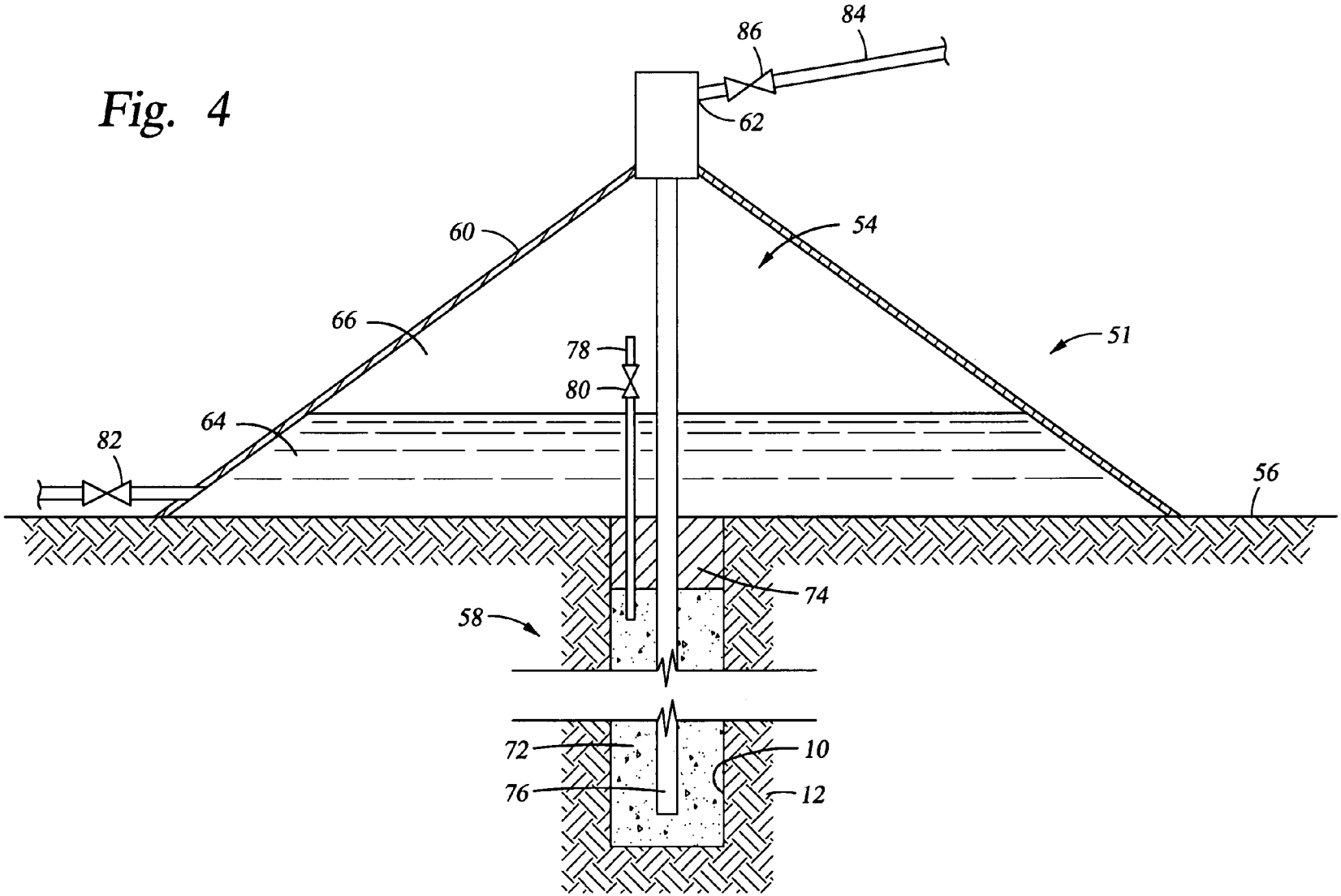
FIG. 4 is a schematic illustration of a gas production system constructed in accordance with embodiments of the present invention.

Once captured in a tubing string, the hydrocarbon gases can be collected and transported via a pipeline, or other means. FIG. 4 illustrates one exemplary system for collecting hydrocarbon gases produced from a hydrate well. Gas collector system 51 includes chamber 54 disposed over a hydrate well 58. Chamber 54 may have substantially rigid walls 60 shaped so that gas collects toward a central outlet 62 at the top of the chamber. Chamber 54 contains a liquid region 64 and a gas region 66. Well 58, which is drilled into hydrate formation 12, includes wellbore 10 containing a column of modified material 72 and a cap 74. Heat source 76 and tubing 78 run through cap 74 into modified column 72. Tubing 78 may include tubing valve 80 to control the flow of produced fluids into chamber 54.

Heat source 76 extends from well 58 into a region of chamber 54 where it is accessible for connections and control. Tubing 78 extends from well 58 into either gas region 66 or water region 64 of chamber 54. Gases in gas region 66 will tend to circulate up along heat source 76 and then back down along chamber walls 60, which are cooled by unconfined seawater or arctic air on the outside of the wall, effectively serving as a cold plate. Gas circulating down along walls 60 will be cooled, and moisture in the gas will condense on the wall and fall into liquid region 64. In this manner, excess moisture can be removed from the gas.

In chamber 54, water is displaced from the liquid region 64 through a control valve 82 as the volume of stored gas increases. Control valve 82 may also be used to control the pressure in gas region 66 by regulating the volume of liquid in liquid region 64. Gas can be removed from chamber 54 through export pipe 84 by regulating one or more export valves 86 controlled either remotely or by the volume of gas in the chamber, or by both.

Thus, chamber 54, when equipped with suitable valve(s) for controlling the gas and liquids inlet, outlet, and pressure, can serve any or all of the multiple functions of accepting gas from the formation, separating the gas from produced water, removing excess moisture from the gas, storing gas, regulating gas pressure, regulating gas into a pipe or hose, preventing water from entering the pipe or hose, and disposing of produced liquid. Chamber 54 is shown in FIG. 4 installed in conjunction with a simple heat-injecting well, but may also be used in conjunction with any of the embodiments presented herein, or any combination thereof.

When chamber 54 is installed on the seafloor 56, gas enters the chamber at or near ambient sea water pressure so a large quantity of gas can be held in a relatively small volume. For example, if the chamber is located at a water depth of 3,300 feet (1,000 meters), the gas occupies approximately 1% of the volume it would occupy at a pressure of one atmosphere. Securing chamber 54 to heat source 76 and/or cap 74 allows the weight and soil-skin friction of the casing and cap to be used to react the buoyancy force of the stored gas.

Figure 5:
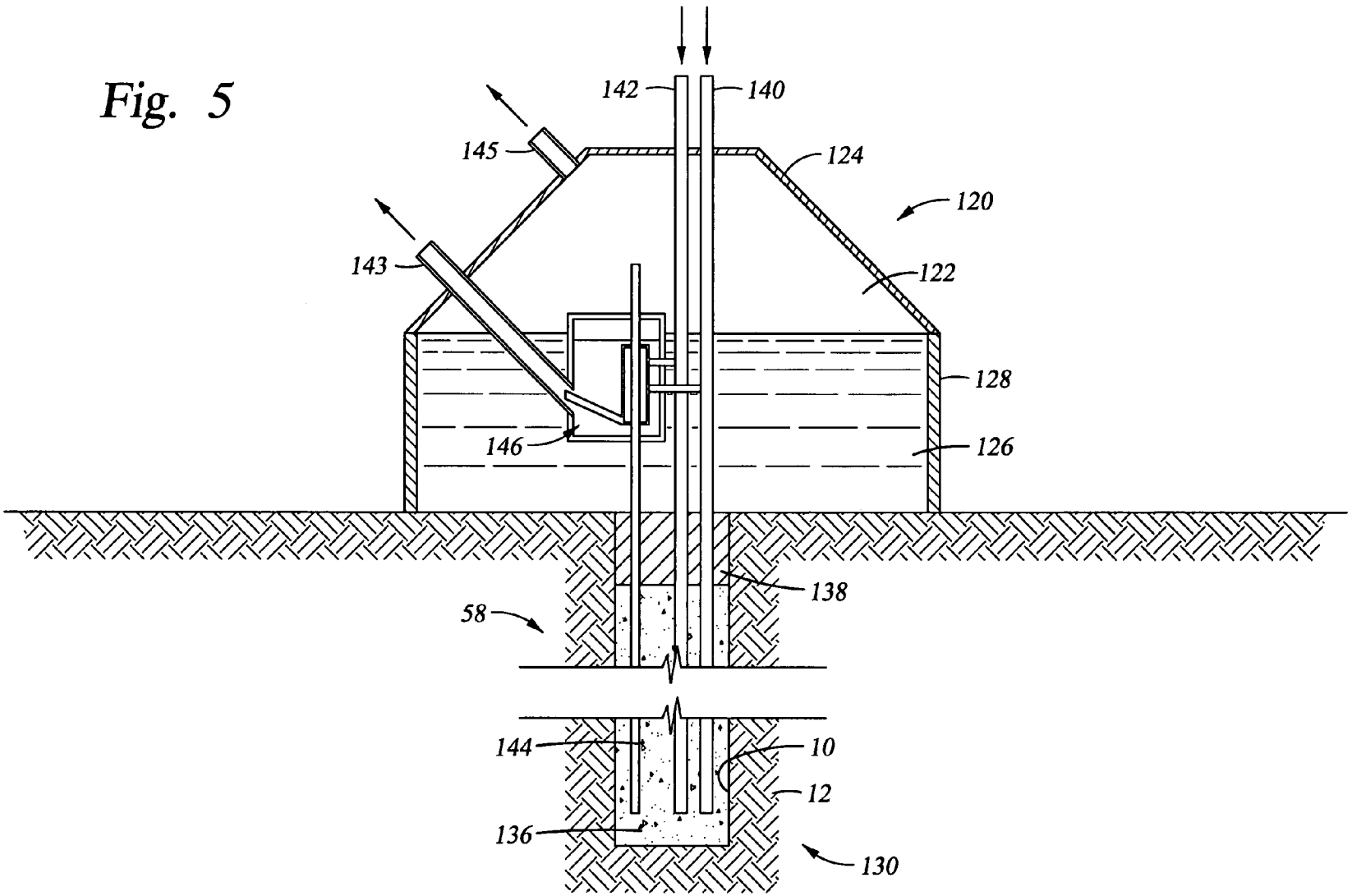
FIG. 5 is a schematic illustration of a gas production system constructed in accordance with embodiments of the present invention.

An alternate chamber embodiment is illustrated in FIG. 5. Chamber 120 includes substantially an upper, gas containing portion 122 having rigid walls 124 and a lower, liquid containing portion 126 having substantially flexible walls 128. Chamber 120 is positioned over well 130, which is drilled into hydrate formation 12, includes wellbore 10 containing a column of modified material 136 and a cap 138. Fuel supply 140 and oxidizer supply 142 are provided to inject combustion gases into well 130 that act as a heat source. Tubing 144 provides a pathway for the passage of gas from well 130 into gas portion 122. Water vent 143 and gas export line 145 are provided to remove water and gas from chamber 120 and may be controlled by valves or other control devices. Chamber 120 also includes heating chamber 146, whose source of heat may come from lines connected to fuel supply 140 and oxygen supply 142.

As with chamber 54 in FIG. 4, chamber 120 provides a system for passively removing water from the produced gases. Gases in gas portion 122 will tend be cooled on chamber walls 124, which are cooled by unconfined seawater on the outside of the wall, effectively serving as a cold plate. Gas circulating along walls 124 will be cooled, and moisture in the gas will condense on the wall and fall into liquid portion 126. In this manner, excess moisture can be removed from the gas. Liquid portion 126 has flexible walls 128, which, when acted on by external pressure, maintain the pressure within chamber 120 at a level equal with the surrounding environment.

As previously discussed, heating hydrate formation 12 will result in both methane and water flowing up through production tubing 144 and into the storage and treatment chamber 120. In order to prevent chamber 120 from filling with water, excess accumulated water must be vented. It is often desirable, both for efficiency and for environmental protection, to strip any dissolved methane from water before it is released. This can be done by routing the vent water through heating chamber 146 to warm it and thereby reduce its ability to hold dissolved gas. FIG. 5 illustrates a heating chamber 146 that is heated by reacting a portion of the fuel and oxidizer used to heat the well that are diverted to the heating chamber. In alternate embodiments, heating chamber 146 can be heated by heated fluid being circulated into the well or by combustion products flowing out of the well and used to warm the heating chamber.

Gas driven from the vented water is released into the storage and treatment chamber 120 where it is captured and mixed with the gas products in gas portion 122. Heating chamber 146 can be placed anywhere in the vent water path but may be preferably placed contiguous with the production tubing as shown in FIG. 5 such that the heating chamber will also raise the temperature of the produced methane in tubing 144. Heating the produced methane above 350° C. will result in the reaction of any residual oxygen that might be present in the production stream due to combustion exhaust gasses having been injected into the modified column. Introduction of heated methane into the gas volume of the storage and treatment vessel 120 will cause the gas to circulate up, toward a wall, and down a cold wall where moisture will be condensed from the gas as previously described.

Figure 6:
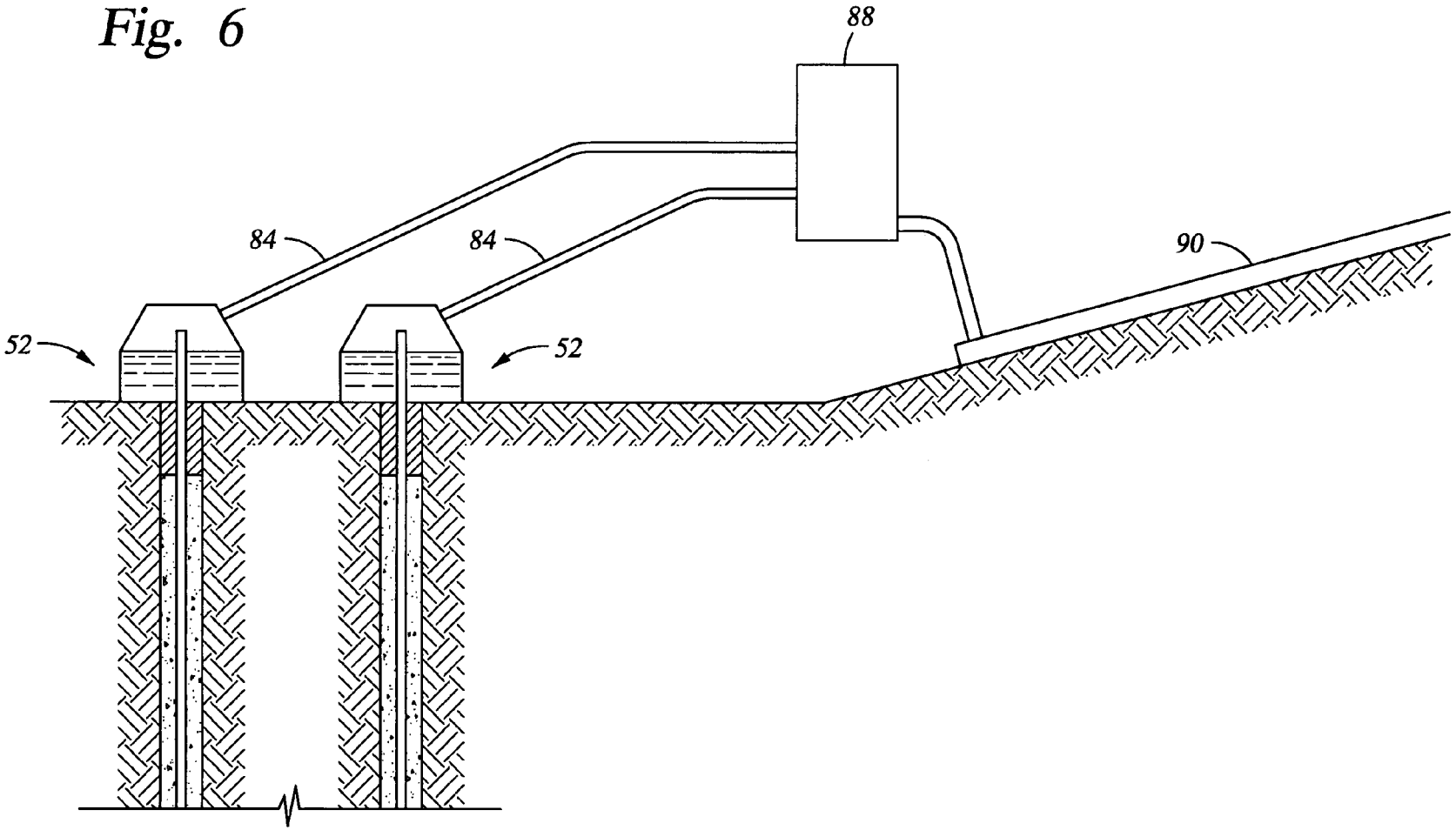
FIG. 6 is a schematic illustration of a multi-well gas production system constructed in accordance with embodiments of the present invention.

In certain applications, a plurality of hydrate production systems 52, which may be arranged in a circular or rectangular array, can be used in cooperation as shown in FIG. 6. Export pipes 84 from multiple production systems 52 combine into a commingled collection chamber 88 that is connected to a pipeline 90. The pressure in collection chamber 88 may be maintained at sufficient pressures to eliminate or reduce the amount of further compression that is required to transport the gas via pipeline 90. It is also recognized that there may still be sufficient moisture in the gas to cause hydrate blockage in the pipes 84 or pipeline 90 if the gas is transported at certain temperatures. To prevent blockage, flow assurance measures, such as methanol injection, may be implemented in the flow path between production systems 52 and pipeline 90. Multiple wells, production systems, and collection chambers may be inter-connected in order to increase the production rate and to average out any irregularity of flow that might occur from an individual well.

The design of the well is one of the most important aspects of any of the above described hydrate production systems. Shown in the above described embodiments is a simple heat-injecting well that produces hydrocarbon gases. Although shown integrated into one well, it is understood that the heat-injecting and the hydrocarbon production functions could be separated into two or more wells. Injecting heat into the hydrate formation releases the hydrocarbon gases from the formation and allows recovery of the gases.

The hydrate formation is analogous to an insulating blanket wrapped around the heat-injecting well. The heat flow in the formation, for a given thermal conductivity and temperature difference, is directly proportional to the surface area of the formation in contact with the heat-injecting well. It is understood that heat transfer, Q, into the formation can be represented by the equation:

$$Q \propto C \cdot T_g \cdot A; \text{ where}$$

C is the thermal conductivity of the material, $T_g$ is the temperature gradient, which is the temperature difference between the heat source and the formation, divided by the distance over which the temperature difference is measured, and A is the surface area over which the heat is exchanged between the heat-injecting well and the formation. Heat flow can be increased by increasing the temperature of the heat-injecting well, but the maximum temperature is limited by practical considerations such as the boiling point of water, formation of salt deposits, dehydration of formation materials, strength of the materials from which the apparatus is made, etc.

Heat transfer can be analyzed by considering the surface of the heat-injecting well as a cylinder, surrounded by concentric cylindrical shells of formation material. Shells further from the well have larger surface area so they conduct the heat more readily. If the thermal conductivity of the heat-injecting well is greater than that of the formation material, then the greatest restriction of heat flow is through the innermost cylindrical shell of formation material, i.e., the one that is in direct contact with the well. Increasing this surface area (such as by increasing the diameter of the heat-injecting well) allows greater heat flow without exceeding the practical limit on maximum temperature.

In the embodiments in which a single heat source is contained within a centrally located tubular member, the formation is warmed by heat flowing through the wall of the tubular member. The amount of heat that can be transferred through the wall of the tubular member is dependent on the surface area of the tubular member, both in contact with the hot medium inside and the modified column outside. Thus, the maximum heat transfer through the tubular member is dependent on the surface area, and therefore the diameter, of the tubular member. Further, the tubular member is preferably constructed from a material with a high thermal conductivity, such as metal.

It is preferred that for a desired amount of heat transfer, the limiting parameters that determine the minimum diameter for the tubular member depend primarily on the temperature, specific heat, and mass flow rate of the fluid or combustion gas that moves through the tubular member. Given turbulent subsonic flow inside the tubular member and maintenance of a temperature below the boiling point of water on the outside of the member, the preferred tubular member has an outside diameter of at least 4 inches.

As discussed earlier, heat transfer is proportional to thermal conductivity times the surface area through which the heat is transferred. Thermal conductivity of the formation depends on local conditions, but a conductivity of 2 Watts/m° C. can be used as representative. If a value of 10 Watts/m° C. is taken as the upper limit on column conductivity, then the ratio of thermal conductivity for the column to the conductivity of the formation is 5. From the proportionality established earlier for heat transfer across a boundary, it is apparent that the outer diameter of the modified column/wellbore must be at least 5 times the diameter of the central heating tubular member. If, as above, the central tubular member has a diameter of 4 inches, the outer diameter of the modified column must be at least 20 inches.

This calculation ignores the effect of temperature drop along a horizontal radial line through the modified column but this is relatively small because, for the case examined here, the separation is only 8 inches. It is apparent that improvement in thermal conductivity of the modified column, a larger and higher energy central element, or improvement in any of the variables subject to engineering manipulation would make it desirable to increase the outer diameter of the modified column since the thermal conductivity of the formation is the most important limiting parameter that can not be optimized by engineering trade-off of physical constraints.

Thus, it can be seen that a large diameter wellbore is preferred. Depending on the properties of the hydrate formation being exploited, wellbores having diameters up to and exceeding 60" are possible. At these large diameters lining the depth of the wellbore with a metal casing is possible but can be cost prohibitive. A metal casing may also create additional challenges with the movement of gas into the wellbore from the formation. Thus, as opposed to lining the wellbore with a casing, the wellbore may be filled with a material that replaces or modifies the formation material to facilitate the movement of gases and the transfer of heat.

Figure 7:
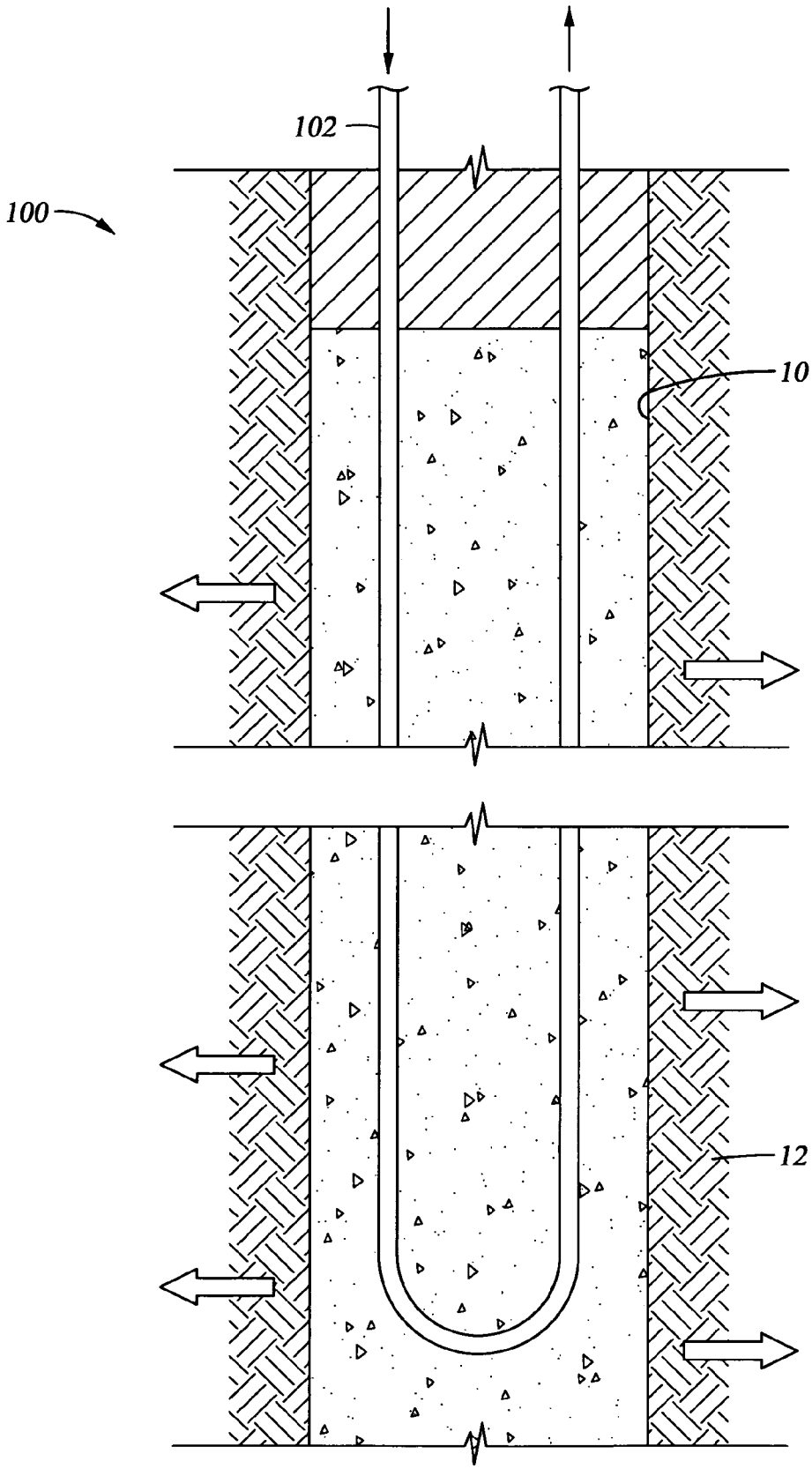
FIG. 7 is a schematic illustration of a well having a circulating heating system constructed in accordance with embodiments of the present invention.

Referring now to FIG. 7, one method for supplying heat to a well 100 includes flowing hot gas or fluid through tubing 102 and circulating the fluid back out of the well 100. In certain embodiments, water, or steam, may be heated by any available energy source and brought to the heat injecting well by insulated pipeline. As the heated liquid, or steam, is pumped through tubing 102, heat is transferred from the heated liquid into wellbore 10. This heat is then transferred across wellbore 10 into formation 12.

Figure 8:
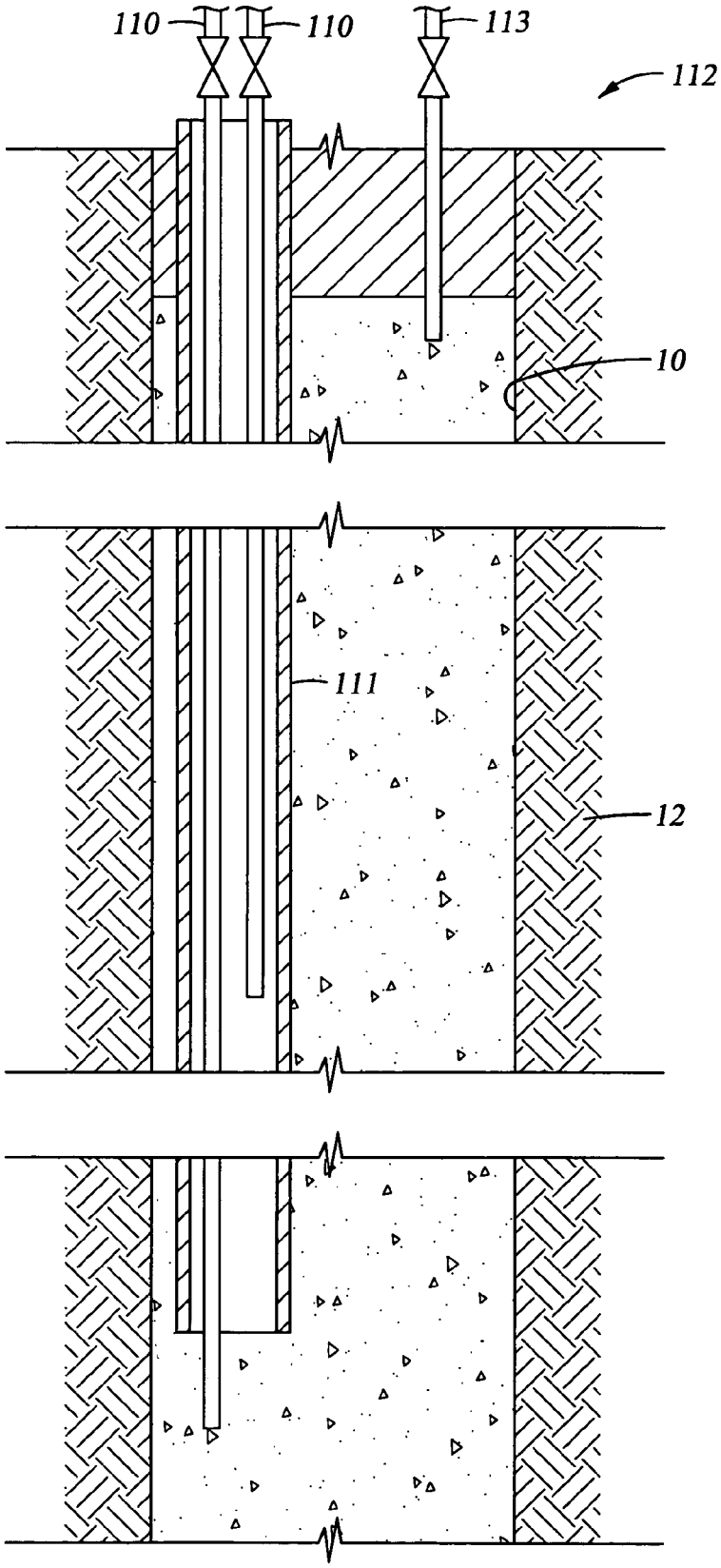
FIG. 8 is a schematic illustration of a well having multiple heat sources constructed in accordance with embodiments of the present invention.

In an alternate embodiment, as shown in FIG. 8, heated liquid, or steam, is pumped directly into wellbore 10 through tubing 110. Tubing 110 may include multiple tubing strings that may be disposed within a larger tubing 111 that carries the heated material to the bottom of well 112. The liquid then cools and is circulated back to the top of well 112 with the released hydrocarbon gases. Tubing 113 carries the produced gas and liquids out of well 112. Alternately, in the well of FIG. 8, combustible materials can be introduced to generate hot gas inside the well with the exhaust gas then flowing out through the well. An independent fuel source can be introduced into the well or used or a portion of the produced gas can be burned with an introduced oxidizer.

Figure 9:
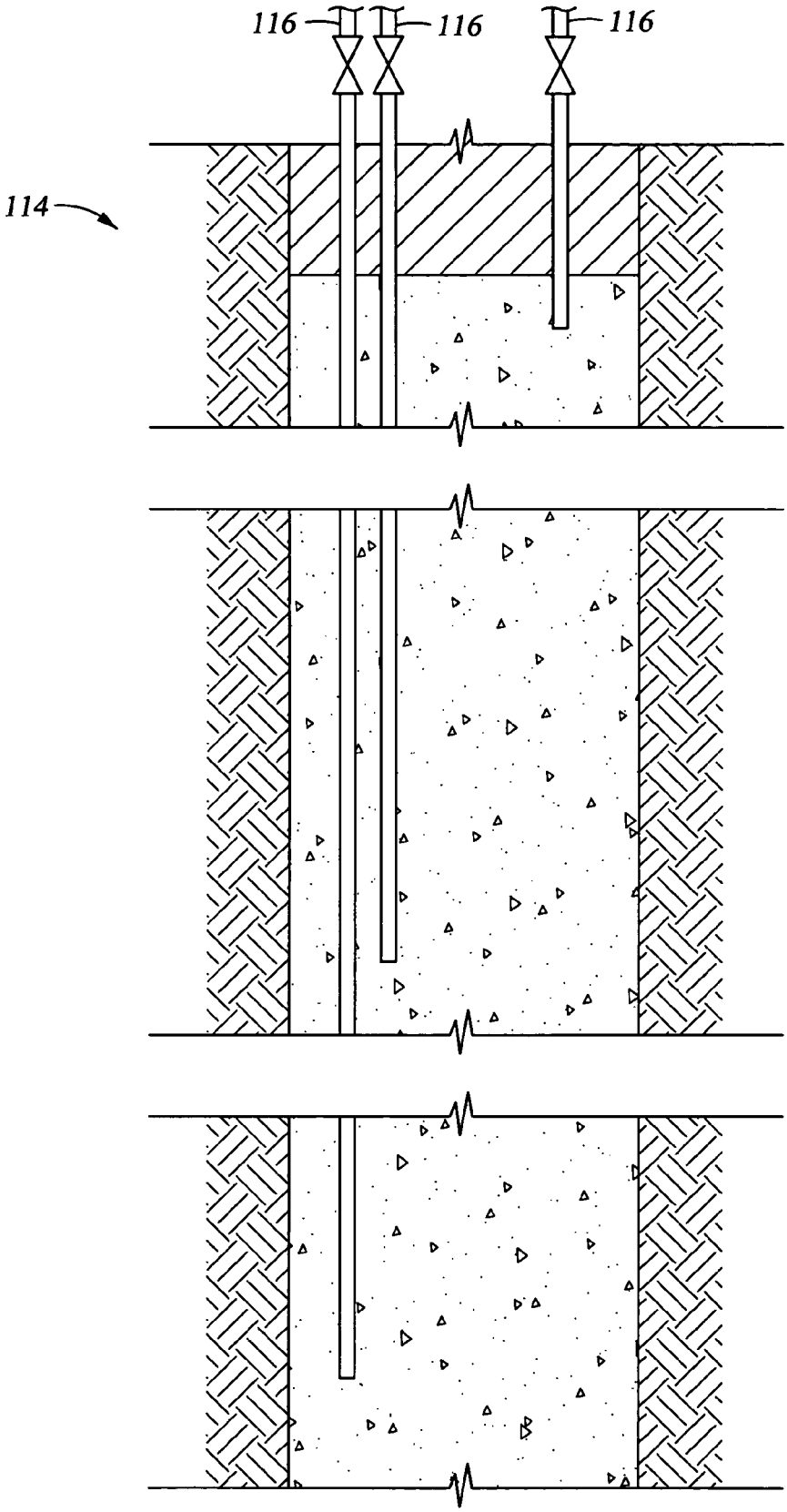
FIG. 9 is a schematic illustration of a well having multiple heat sources constructed in accordance with embodiments of the present invention.

FIG. 9 illustrates another alternate well 114 having multiple tubing strings 116. Tubing strings 116 allow for fluids to be injected at one elevation and extracted at another. Tubing 116 can also be used to provide different heating levels at different depths within well 114. Tubing 116 can also be used to inject materials to control permeability and heat transfer. Thus, multiple tubing strings 116 can be used to produce gas, to inject materials, to modify permeability, to modify thermal conductivity, to inject or circulate heated fluid, or to kill the well by circulating cold fluid to remove heat and chill formation materials in proximity to the well.

Figure 10:
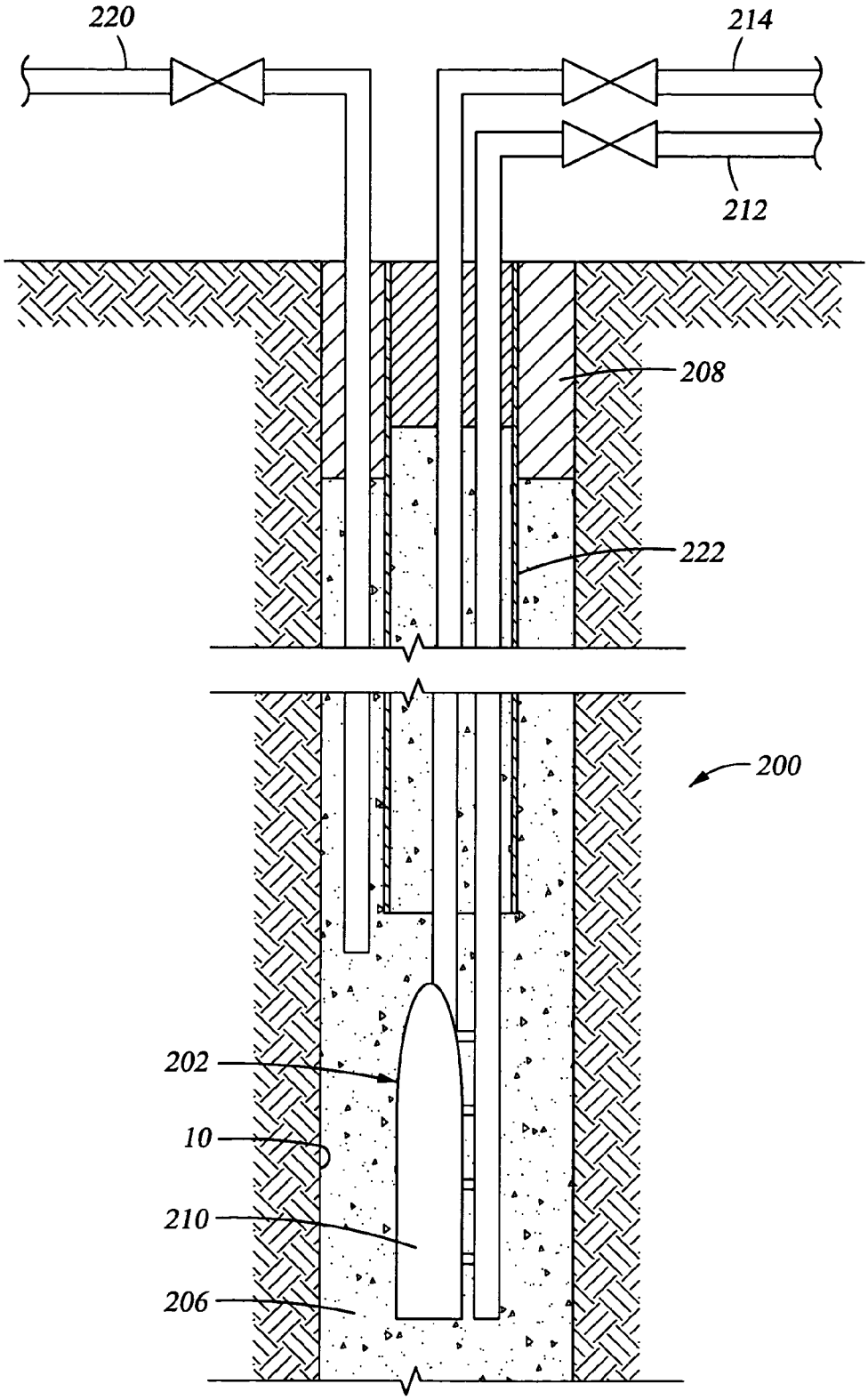
FIG. 10 is a schematic illustration of a well having a combustion chamber constructed in accordance with embodiments of the present invention.
Figure 11:
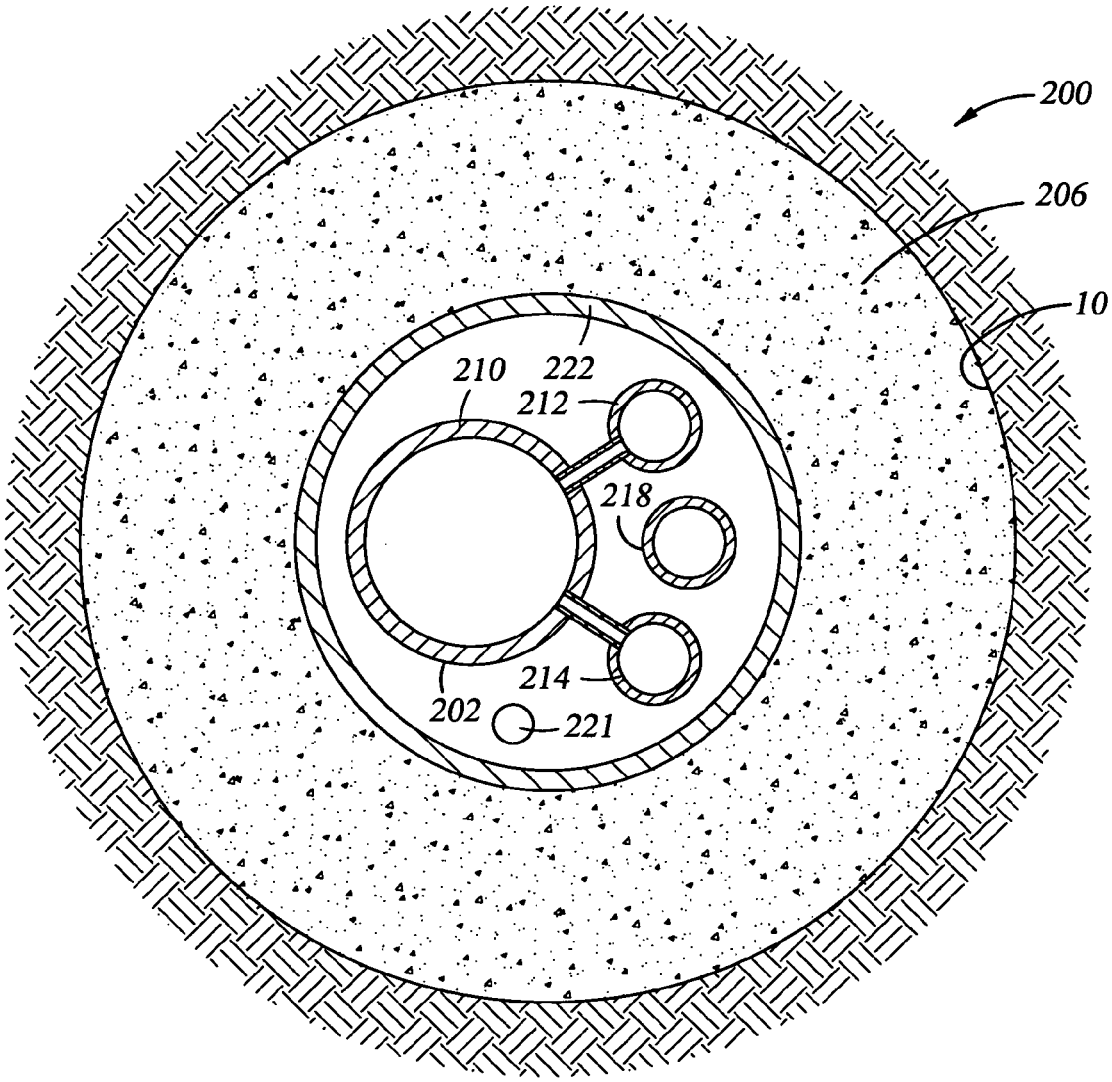
FIG. 11 is a cross-sectional schematic illustration of the well of FIG. 10.

FIGS. 10 and 11 illustrate one embodiment of a well 200 having a heat source 202 including downhole combustion. Well 200 includes wellbore 10 having a column of modified material 206 disposed below an impermeable cap 208. Heat source 202 includes combustion chamber 210, fuel supply 212, and oxidizer supply 214, all of which may be disposed within a single large diameter tubing 222. Tubing 222 may also include a temperature sensor 221 and intervention tubing 218, which provides additional access to column 206 and may be used for a variety of purposes. Production tubing 220 provides a pathway for produced gas to bypass cap 208.

Fuel 212 and oxidizer 214 are preferably combusted at select regions along chamber 210 in order to regulate the amount of heat transferred into the formation at varying depths. Combustion chamber 210 provides for the reaction of fuel and oxidizer and allows combustion products to flow downward for injection into the modified column 206 or upward to be vented. One reactant may flow in the combustion chamber 210 and the other in a separate tubing, or each reactant may flow in separate tubing and be injected into the combustion chamber.

In some embodiments, a well may not be used to produce gas but only to inject heat into the formation in order to facilitate production through other wells. For a non-producing, heat-injecting well the thermally conductive material may be formulated so as to block the migration of gas. Migration can be blocked by, for instance, injecting a material formulated for the desired thermal characteristics, such as grout or resin, that will solidify.

The heat-injecting wells described above may be used as an alternative to, or in conjunction with, conventional pressure relief production wells that may be used to tap pressurized gas from the hydrate zone. A heat-injecting well can be used to produce natural gas from hydrate deposits while a nearby pressure relief well is producing, or after a nearby pressure relief well has depleted the hydrates that are suitable for production by pressure relief methods. Heat-injecting wells can also be used in conjunction with pressure relief wells such that one or more heat-injecting wells replace the heat absorbed by thawing of hydrates so as to sustain flow in a pressure relief well past the time when gas flow would otherwise decrease and eventually stop.

Figure 12:
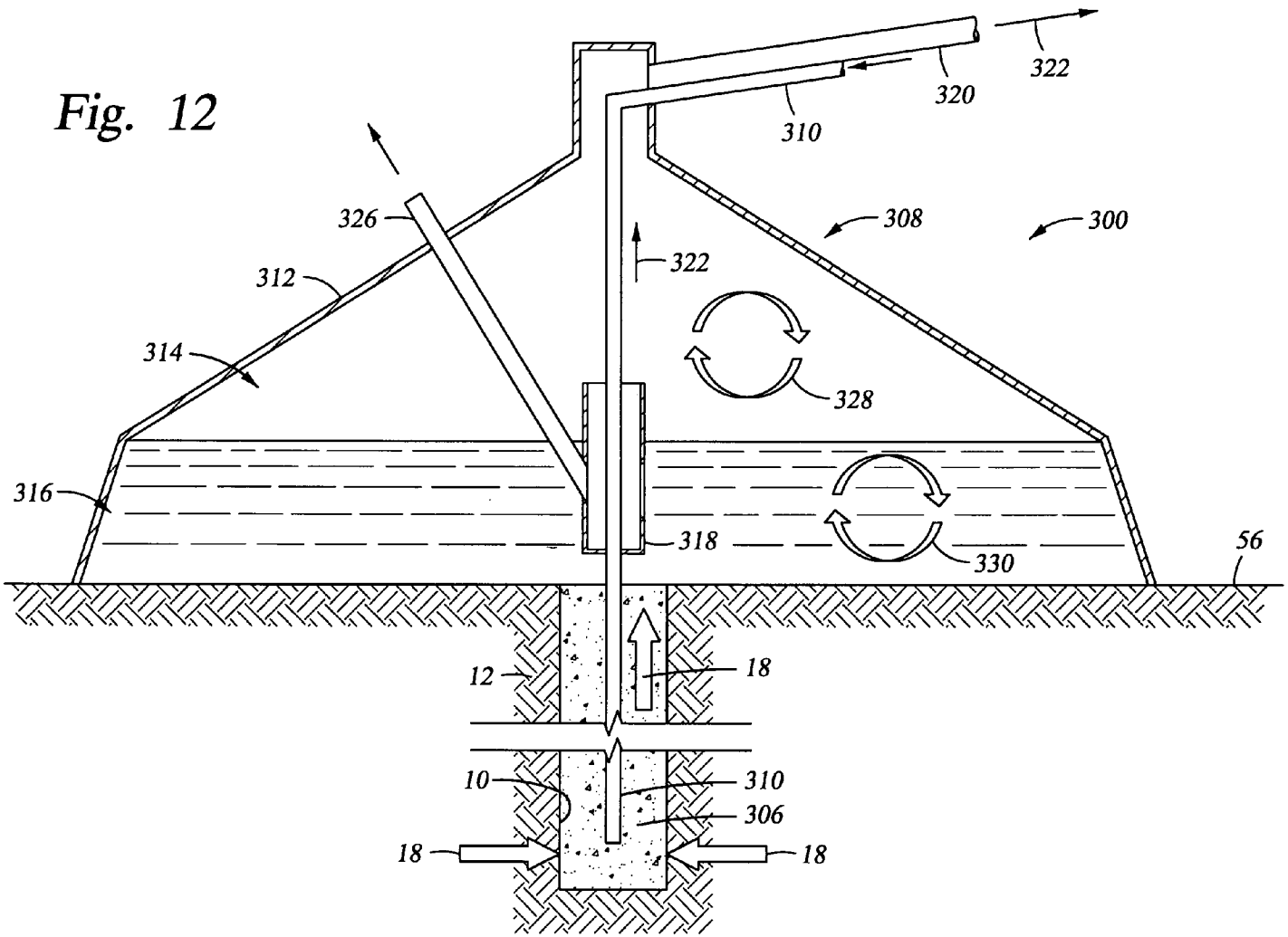
FIG. 12 is a schematic illustration of a gas production system constructed in accordance with embodiments of the present invention.

Referring now to FIG. 12, another embodiment of a hydrate production apparatus 300 is shown in including a wellbore 10 formed in a hydrate formation 12. The wellbore is filled with a column of modified material 306 and the top of the wellbore is enclosed by a gas collector 308. A heat source 310 extends into the column of modified material 306. Gas collector 308 includes a chamber 312 having a water/gas separator 318, outlet 320, and liquid region 316, and gas region 314.

Wellbore 10 may be formed by drilling or jetting into hydrate formation 12. Wellbore 10 may be filled with the column of modified material 306 as the wellbore 10 is formed. In some embodiments, column of modified material 306 is formed from a granular, or particulate, solid material, such as gravel or sand, that forms interstitial areas between adjacent solid particles. These interstitial areas make the column of modified material 306 permeable to gases.

Heat source 310 may be at tubular member that extends into the column of modified material 306. Heat source 310 provides a conduit through which a heated fluid, such as steam, can be pumped to a desired location within the column of modified material 306. As heat is injected into the column of modified material 306, the heat is transferred to the surrounding hydrate formation 12. This heat causes methane gas 18 to be released from the hydrate formation 12 and flow into the column of modified material 306. The temperature of the heated fluid can be regulated to control the flow of gas 18 into the column 306. In certain embodiments, an ambient or cooled fluid can be injected through heat source 310 to effectively stop the flow of gas 18 into column 306.

Gas 18 will flow up through the column of modified material 306 towards collector 308 located at the seafloor 56. Gas 18 enters gas region 314 where contact with the cool walls of chamber 312 causes water to condense and fall into liquid region 316. Gas/liquid separator 318 uses the heat from heat source 310 to remove further gas from the water before excess water is removed through vent 326. Heat source 310 also serves to heat both gas region 314 and liquid region 316 to create circulation currents 328 and 330. Outlet 320 provides fluid communication to a production unit or gas export pipeline.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the system and apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. An apparatus for producing methane gas from a hydrate formation comprising:

a column of modified material substantially filling a wellbore extending into the hydrate formation, wherein said column of modified material is permeable to gases; and a heat source extending into said column of modified material and operable to provide heat to the hydrate formation so as to release methane gas from the hydrate formation.

2. The apparatus of claim 1 wherein the outer surface of said column of modified material is in contact with the hydrate formation.

3. The apparatus of claim 1 further comprising a gas collector in fluid communication with said column of modified material, wherein said gas collector is operable to control the flow of methane gas out of said column of modified material.

4. The apparatus of claim 3 wherein said gas collector is disposed within said column of modified material.

5. The apparatus of claim 4 wherein said gas collector further comprises:

an impermeable barrier disposed within said column of modified material; and a path for fluid communication through said impermeable barrier; and a valve for selectably closing said path for fluid communication.

6. The apparatus of claim 3 wherein said gas collector is disposed on the seafloor above said column of modified material.

7. The apparatus of claim 6 wherein said gas collector further comprises:

a chamber operable to receive gases from said column of modified material; and a separator for removing water from the methane gas.

8. The apparatus of claim 1 wherein said column of modified material comprises a plurality of zones, wherein selected properties of said column of modified material vary between the plurality of zones.

9. The apparatus of claim 8 wherein the selected properties include thermal conductivity.

10. The apparatus of claim 8 wherein the selected properties include permeability.

11. The apparatus of claim 1 wherein said column of modified material has a thermal conductivity higher than hydrate formation.

12. The apparatus of claim 1 wherein said heat source comprises a supply of steam.

13. The apparatus of claim 1 wherein said heat source comprises an electrical resistance heater.

14. The apparatus of claim 1 wherein said heat source comprises a supply of oxidizer for supporting combustion within said column of modified material and isolated from the formation.

15. The apparatus of claim 14 wherein said heat source further comprises a supply of fuel adapted to react with said supply of oxidizer to generate combustion gases within said column of modified material.

16. The apparatus of claim 1 wherein said heat source comprises a supply of heated combustion gases.

17. The apparatus of claim 1 wherein cooled or ambient temperature liquid or gas is circulated in to the column.

18. The apparatus of claim 1 wherein said column of modified material acts as a filter to prevent unconsolidated formation material from preventing the permeation of methane gas through the column.

19. A system for extracting methane gas from a hydrate formation, said system comprising:

a wellbore extending into the hydrate formation;

a column of modified material substantially filling said wellbore and in direct contact with the hydrate formation, wherein said column of modified material is permeable to gas;

a heat source operable to provide heat to said column of modified material, wherein the heat is transferred through said column of modified material to the hydrate formation so as to heat the formation and release methane gas into said column of modified material; and a gas collector in fluid communication with said column of modified material, wherein said gas collector is operable to control the flow of methane gas out of said column of modified material.

20. The system of claim 19 wherein said column of modified material acts as a filter to prevent unconsolidated formation material from preventing the permeation of methane gas through the column.

21. The system of claim 19 wherein said gas collector is disposed within said column of modified material.

22. The system of claim 21 wherein said gas collector further comprises:

an impermeable barrier disposed within said column of modified material; and a path for fluid communication through said impermeable barrier; and a valve for selectably closing said path for fluid communication.

23. The system of claim 19 wherein said gas collector is disposed on the seafloor above said column of modified material.

24. The system of claim 23 wherein said gas collector further comprises:

a chamber having a gas region and a liquid region;

a volume regulator operable to regulate the volume of liquid in the liquid region so as to control the pressure within the gas region;

a water-gas separator operable to remove water from the methane gas; and an export valve to regulate the flow of gas from the gas region into an export pipe.

25. The system of claim 23 wherein said gas collector further comprises a water-gas separator operable to remove water from the methane gas.

26. The system of claim 19 wherein the heat source further comprises a supply of a heated liquid or gas.

27. The system of claim 26 wherein cooled or ambient temperature liquid or gas is circulated into the column.

28. The system of claim 19 wherein said heat source comprises an electrical resistance heater.

29. The system of claim 19 wherein said heat source comprises a supply of oxidizer for supporting combustion within said column of modified material and isolated from the producing formation.

30. The system of claim 29 wherein said heat source further comprises a supply of fuel adapted to react with said supply of oxidizer to generate combustion gases within said column of modified material.

31. The system of claim 19 wherein said heat source comprises a supply of heated combustion gases.

32. A method for extracting hydrocarbon gases from a hydrate formation, the method comprising:

drilling a wellbore into the hydrate formation;

substantially filling the wellbore with a modified material that is permeable to gases, supplying heat to the modified material so as to heat the hydrate formation and release hydrocarbon gases from the formation; and collecting at least a portion of the hydrocarbon gases that flow into the wellbore.

33. The method of claim 32 wherein the modified material is relatively impermeable to particulate solids so as to inhibit migration of unconsolidated formation materials.

34. The method of claim 32 wherein heat is supplied by injecting a heated gas or liquid into the column of modified material.

35. The method of claim 32 further comprising injecting an ambient or cooled gas or liquid into the column of modified material so as to stop the release of hydrocarbon gases from the formation.

36. A method of producing gas from a gas hydrate formation comprising:

forming a modified column of material which includes a heat source within said column, said modified column of material extending down into said gas hydrate formation and being substantially uncased above the producing formation;

supplying heat to said heat source in said modified column of material whereby the heat from said heat source is thermally conducted by the modified material to said hydrate formation releasing gas from said formation; and allowing said gas formed from said formation to flow through said uncased modified column to the location where said gas is separated from the water.

37. A method according to claim 36 that further includes:

passing the gas from said uncased modified column into a chamber disposed over the uncased modified column, said chamber having cooled walls to condense moisture from the gas in said chamber.

38. A method according to claim 36 that further includes:

storing gas in a chamber at ambient pressure in close proximity to and above the modified column.

39. An apparatus for producing methane gas from a hydrate formation comprising:

an uncased modified column of material which includes a heat source within said column, said modified column of material beginning substantially at the surface and extending down into said gas hydrate formation;

means for providing heat to said heat source; and a chamber disposed over said uncased modified column containing a liquid region and a gas region where gas flowing up the modified column is captured.

* * * * *